US009119975B2

(12) United States Patent
Hu et al.

(10) Patent No.: US 9,119,975 B2
(45) Date of Patent: Sep. 1, 2015

(54) RESPIRATOR WAIST BELT

(75) Inventors: Jia Hu, Mounds View, MN (US); Kenneth J. Krepel, North St. Paul, MN (US); John M. Pilgrim, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 363 days.

(21) Appl. No.: 13/396,858

(22) Filed: Feb. 15, 2012

(65) Prior Publication Data

US 2013/0206806 A1 Aug. 15, 2013

(51) Int. Cl.

| | |
|---|---|
| ***A45F 5/02*** | (2006.01) |
| ***A62B 9/04*** | (2006.01) |
| ***A62B 25/00*** | (2006.01) |
| ***A45F 3/00*** | (2006.01) |
| ***A62B 18/00*** | (2006.01) |
| *A45F 3/14* | (2006.01) |
| *A62B 7/10* | (2006.01) |

(52) U.S. Cl.

CPC . *A62B 9/04* (2013.01); *A45F 3/005* (2013.01); *A62B 18/006* (2013.01); *A62B 25/00* (2013.01); *A45F 5/021* (2013.01); *A45F 2003/144* (2013.01); *A45F 2200/0591* (2013.01); *A62B 7/10* (2013.01)

(58) Field of Classification Search

CPC ..... A45F 5/021; A45F 3/14; A45F 2003/144; A45F 5/00; A41F 9/002

USPC ..... 2/338; 224/662, 660, 663, 665–668, 224/904

See application file for complete search history.

(56) References Cited

U.S. PATENT DOCUMENTS

| | | | | |
|---|---|---|---|---|
| 2,945,614 | A * | 7/1960 | Wittmann | 224/148.7 |
| 3,878,589 | A * | 4/1975 | Schaefer | 24/669 |
| 4,384,372 | A * | 5/1983 | Rector | 2/300 |
| 4,389,635 | A | 6/1983 | Gallagher | |
| 4,747,527 | A * | 5/1988 | Trumpower, II | 224/662 |
| 4,899,740 | A | 2/1990 | Napolitano | |
| 5,152,443 | A * | 10/1992 | Hagan | 224/662 |
| 5,604,958 | A * | 2/1997 | Anscher | 24/3.1 |
| 5,762,243 | A | 6/1998 | McMaster | |
| 5,833,095 | A | 11/1998 | Russell | |
| 5,996,184 | A | 12/1999 | Mah | |
| 6,038,747 | A | 3/2000 | Hamilton | |
| 6,206,257 | B1 | 3/2001 | Peele | |

(Continued)

FOREIGN PATENT DOCUMENTS

| | | |
|---|---|---|
| EP | 692 206 A1 | 1/1996 |
| EP | 0747095 | 12/1996 |

(Continued)

OTHER PUBLICATIONS

International Application No. PCT/US2013/025249 Search Report dated Feb. 4, 2014.

*Primary Examiner* — Brian D Nash
*Assistant Examiner* — Corey Skurdal
(74) *Attorney, Agent, or Firm* — Eric D. Levinson

(57) ABSTRACT

A wearable belt for supporting a respiratory component is disclosed. The belt includes a first end portion, a second end portion, and an interface portion that includes an inner layer, an outer layer, and a rigid attachment element in contact with the inner layer and the outer layer. The rigid attachment element is configured to mate with a corresponding feature of a respiratory component.

18 Claims, 9 Drawing Sheets

(56) References Cited

U.S. PATENT DOCUMENTS

| | | | | |
|---|---|---|---|---|
| 6,401,715 | B1 | 6/2002 | Luthe | |
| 6,405,910 | B1 | 6/2002 | Infanti | |
| 6,405,911 | B1 | 6/2002 | Howard | |
| 6,508,390 | B1 | 1/2003 | Karpati | |
| 7,454,800 | B2 | 11/2008 | Taylor | |
| 7,658,190 | B1 | 2/2010 | Phifer | |
| 7,726,312 | B2 | 6/2010 | Chapman | |
| 7,762,440 | B2 * | 7/2010 | Cook | 224/195 |
| 7,819,120 | B2 * | 10/2010 | Taylor et al. | 128/206.27 |
| 7,900,278 | B2 | 3/2011 | Pittman | |
| D646,379 | S | 10/2011 | Huh | |
| 2002/0078959 | A1 | 6/2002 | Haeuser | |
| 2002/0134809 | A1 | 9/2002 | Angus | |
| 2002/0185509 | A1 | 12/2002 | Wichman | |
| 2003/0042284 | A1 | 3/2003 | Reiserer | |
| 2003/0070211 | A1 | 4/2003 | Crye | |
| 2005/0145251 | A1 | 7/2005 | Taylor | |
| 2009/0156972 | A1 * | 6/2009 | Cavalieri et al. | 602/19 |
| 2009/0277936 | A1 | 11/2009 | Rogers | |
| 2009/0314295 | A1 | 12/2009 | Hatmaker | |
| 2010/0200624 | A1 | 8/2010 | Chapman | |
| 2010/0294822 | A1 | 11/2010 | Haight | |
| 2010/0310823 | A1 | 12/2010 | Albertelli | |
| 2011/0126713 | A1 | 6/2011 | Legare | |

FOREIGN PATENT DOCUMENTS

| | | |
|---|---|---|
| WO | 96/28065 | 9/1996 |
| WO | 2007/142382 A1 | 12/2007 |

* cited by examiner

RESPIRATOR WAIST BELT

TECHNICAL FIELD

This invention relates to a waist belt having a composite structure for supporting respiratory components, in particular a waist belt having a rigid attachment element for supporting respiratory components.

BACKGROUND

Fan-forced positive pressure breathing devices, commonly referred to as powered air purifying respirators (PAPRs), and other respiratory components are used by first responders, military, and other emergency response units to manage respiratory exposure. These and other respiratory components are also used in various industrial applications to manage exposure to gases, vapors, and particulate matter. A respiratory system may include a breathing mask, or other suitable hood, helmet, or hardtop, having an inlet for filtered air and defining a zone of breathable air for a user. Such systems are employed to continually supply positive pressure to the breathable air zone.

Respiratory system components, and particularly PAPR components, have been connected to a belt threaded through slots in the housing of the respiratory component. The user wears the belt supporting the respiratory components about their waist, and the load is normally at the rear of the belt. In addition to carrying the respiratory component, the user also wears or carries additional equipment, such as a hood, and other components of the respiratory system, which may also be connected to the belt.

The respiratory system components generally should be securely connected to the belt, such that the components do not become inadvertently separated from the belt during use. In addition, the attachment mechanism should facilitate ease of attachment and detachment of the respiratory component to and from the belt.

The respiratory system and its components may be exposed to hazardous environments, which cause contamination to those components, including any related attachment mechanisms for securing the respiratory component to the belt. Discarding contaminated equipment is costly, and thus the respiratory components may be capable of decontamination after each use.

Various designs have been proposed for providing a respiratory system including a respiratory system component connected to a waist-mounted belt.

For example, U.S. Pat. No. 7,819,120 (Taylor et al.), describes a respiratory component mounting assembly including a belt, a respiratory component, and a mounting clip for mounting the respiratory component to the belt. The belt and respiratory component each include at least two spaced apart clip openings, and the mounting clip includes an intermediate portion and two spaced apart free ends. The intermediate portion of the mounting clip is received within both of the clip openings of the belt and the free ends of the mounting clip are received in the clip openings of the second respiratory component for securing the belt and respiratory component together.

SUMMARY

Glossary

In reference to the invention, the following terms are defined as set forth below:

"And/or" means "and", "or", and a combination of "and" and "or".

"Adjacent" means in close proximity but not necessarily in contact.

"PAPR" means powered air purifying respirator.

"Portion" means part of a larger thing.

"Integrally formed" means formed as unitary component.

"Rigid attachment element" refers to a rigid structure configured to releasably secure a corresponding feature of a respiratory component.

"Rigid retention element" refers to a rigid structure that inhibits flexure of the interface portion of a belt about a longitudinal axis of the belt.

"Vertical axis of a user" means an axis along the height of the user and generally aligned to the direction of gravity when the user is in an upright position.

The present invention provides for a respiratory component assembly including a PAPR component having an interface surface with a first projection extending outwardly from the interface surface, and a wearable belt for supporting the PAPR component having a longitudinal axis along a length of the belt and an interface portion including a rigid attachment element and a rigid retention element secured to a portion of the belt. The rigid attachment element is fastened to a portion of the belt and configured to receive the first projection to releasably secure the PAPR component to the belt, and the rigid retention element inhibits flexure of the interface portion about the longitudinal axis of the belt when the belt is fastened on a user. The first projection may be integrally formed with the interface surface of the PAPR component, and the rigid attachment element may be formed separately from the rigid retention element. In an exemplary embodiment, the rigid retention element is adjacent to a lower peripheral edge of the interface portion of the belt. The interface portion of the belt further includes an inner layer and an outer layer, and the rigid attachment element and rigid retention element are in contact with the inner layer and the outer layer. The rigid attachment element and the rigid retention element may form a unitary component. The interface surface may further include second, third, and fourth projections spaced on the interface surface in a rectangular configuration. In an exemplary embodiment, the first projection includes a T-shaped projection. In another exemplary embodiment, the first projection includes a first portion extending in a direction outwardly from the interface surface, and a second portion extending in a direction parallel to the interface surface and spaced apart from the interface surface. In an exemplary embodiment, the PAPR component further includes a retention projection extending outwardly from the interface surface, and the retention projection contacts an edge of the interface portion of the belt to prevent upward movement of the PAPR component with respect to the belt when the belt is fastened on a user.

The present invention further provides a respiratory component assembly including a supplied air respirator component having a longitudinal axis along a length of the belt and an interface surface with a first projection extending outwardly from the interface surface, and a wearable belt for supporting the supplied air respirator component having an interface portion with a rigid attachment element and a rigid retention element. The rigid attachment element is fastened to a portion of the belt and configured to receive the first projection to releasably secure the supplied air respirator component to the belt, and the rigid retention element is positioned along a lower peripheral edge of the interface portion of the belt and inhibits flexure of the interface portion about the longitudinal axis of the belt when the belt is fastened on a user.

The present invention further provides a respiratory component assembly including a PAPR component having a filter, a motor for driving a fan, and a battery electrically connected to the motor, and having an interface surface with a first projection extending outwardly from the interface surface, a wearable belt for supporting the PAPR component having a longitudinal axis along a length of the belt and an interface portion including a rigid attachment element and a rigid retention element, a face piece defining a zone of breathable air for a user, and a hose for providing a fluid connection between the PAPR component and the face piece. The rigid attachment element is fastened to a portion of the belt and configured to receive the first projection to releasably secure the PAPR component to the belt, and the rigid retention element inhibits flexure of the interface portion about a longitudinal axis of the belt when the belt is fastened on a user.

The present invention further provides a wearable belt for supporting a respiratory component including a first end portion, a second end portion, and an interface portion between the first and second end portions. The interface portion includes an inner layer, an outer layer, and a first rigid attachment element in contact with the inner layer and the outer layer and is configured to mate with a corresponding feature of a PAPR component. The inner layer, the outer layer, and the first rigid attachment element each define an opening, and the openings are at least partially aligned to form a first common opening extending through the interface portion. In an exemplary embodiment, the rigid attachment element includes one or more flanges extending over a portion of the inner layer and the outer layer, and includes an exposed surface configured to contact a corresponding feature of a PAPR component when a PAPR component is releasably secured to the belt. In another exemplary embodiment, the interface portion includes a lower peripheral edge and a rigid retention element between the inner layer and the outer layer having a lower edge adjacent to the lower peripheral edge of the interface portion. In another exemplary embodiment, the first rigid attachment element and the rigid retention element form a unitary component.

The above summary of the present invention is not intended to describe each disclosed embodiment or every implementation of the present invention. The Figures and the Detailed Description, which follow, more particularly exemplify illustrative embodiments.

BRIEF DESCRIPTION OF DRAWINGS

The present invention will be further explained with reference to the appended Figures, wherein like structure is referred to by like numerals throughout the several views, and wherein.

DETAILED DESCRIPTION

Figure 1:
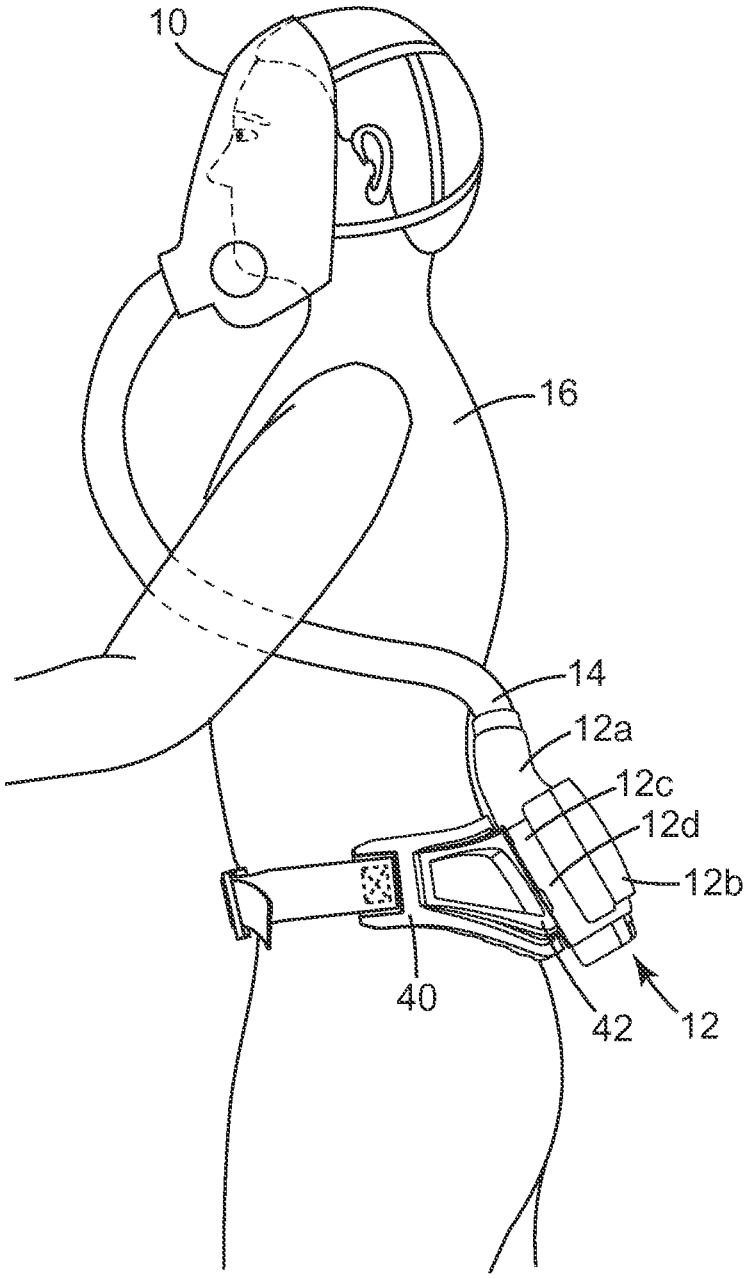
FIG. 1 is an illustration of an exemplary respiratory protection system worn by a user.

FIG. 1 shows a respiratory protection system worn by a user. The respiratory protection system includes a breathing face-piece 10, or head gear, and a respiratory component 12, such as a PAPR, an air filter, or some other component device which may be used in a respiratory system, such as an air quality monitor. An air hose or tube 14 connects the respiratory component 12 to the breathing face-piece 10 to supply breathable air to a user 16. Breathing face-piece 10, or head gear, may be a breathing mask, hood, helmet, hardtop, or other suitable component having an inlet for filtered air, and defining a zone of breathable air for a user. Respiratory component 12 is designed to be worn by a user in an atmosphere with unwanted contaminants, including respiratory hazards. In the embodiment shown in FIG. 1, PAPR 12 has a housing 12*a* and one or more filters 12*b*, which serve to filter unwanted contaminants from the surrounding atmosphere, thus allowing a user wearing the PAPR to work in contaminated or hazardous areas. PAPR 12 may also include, within the housing 12*a*, a fan 12*c*, a motor 12*d* for driving the fan, and a battery 12*e* electrically connected to the motor. One example of a PAPR is described in U.S. Pat. No. 6,575,165, titled "Apparatus and Method for Breathing Apparatus Component Coupling."

The present invention provides a waist-mounted respiratory component system including a decontaminable belt for supporting a respiratory component. Belt 40 may be used with a variety of respiratory components for hands-free use in contaminated areas. Belt 20 and respiratory component 12 each include corresponding mating features that allow for quick and secure attachment of the respiratory component to the belt, while minimizing hidden surfaces that may inhibit efficient and effective decontamination of belt 40 or respiratory component 12. Respiratory component 12 is releasably secured to belt 40 for carrying by the user 16 and positioned such that the load is carried at the rear of belt 40. In an exemplary embodiment, belt 40 is configured to support the belt about the hips of the user 16. Belt 40 cushions the back of the user from the pressure of hard edges of respiratory component 12, while maintaining rigidity to support the respiratory component in the desired position on the user 16. Respiratory component housing 12*a* and belt 40 may be formed from a decontaminable material such that after respiratory component housing 12*a* and the belt are used in a contaminated area, they may be decontaminated for future reuse.

In an exemplary embodiment, belt 40 includes bumper wings 42 positioned adjacent to the interface potion of the belt and provide protection for the edges of the respiratory component 12. The bumper wings may be formed in the belt by laminating layers of materials, as described further below, and may be hollow or have sufficient flexibility such that the bumper wing is compressible and the belt remains comfortable and functional on a range of waist sizes. The bumper wings prevent the edges of the respiratory component from catching on elements in the external environment that may cause the respiratory component to become detached from the belt, and protect the respiratory component from damage.

Figure 2:
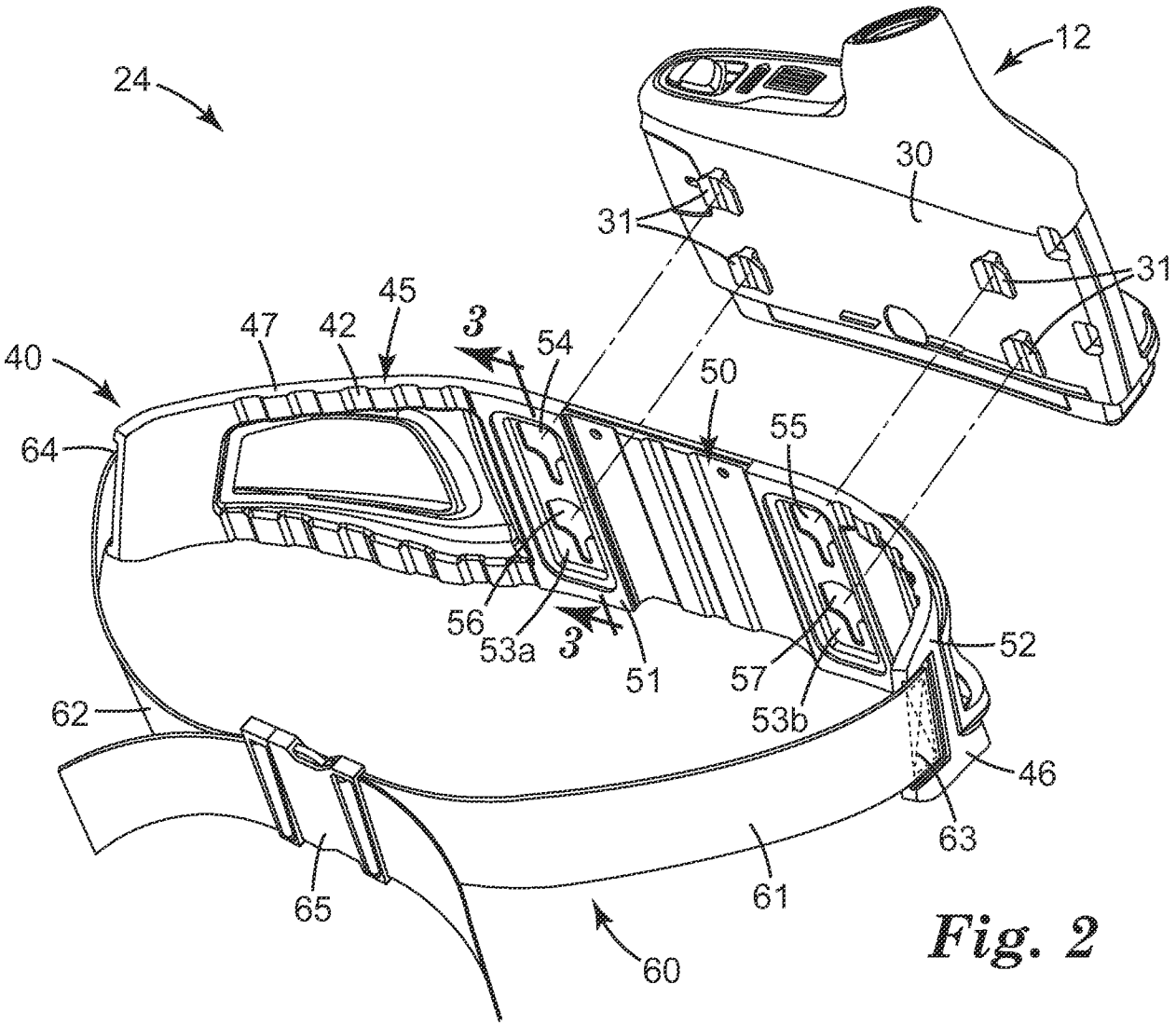
FIG. 2 is an exploded perspective view of an exemplary embodiment of a waist-mounted respiratory component system according to the present invention.

FIG. 2 is an exploded perspective view of an exemplary embodiment of a waist-mounted respiratory component system 24 according to the present invention. Waist-mounted respiratory component system 24 includes a belt 40, and an exemplary respiratory component 12 in the form of a PAPR component. Respiratory component 12 includes an interface surface 30 having one or more projections 31 extending outwardly from the interface surface. Belt 40 includes an interface portion having one or more rigid attachment elements 53 and one or more rigid retention elements. One or more rigid attachment elements 53 are configured to receive one or more projections 31 to releasably secure respiratory component 12 to belt 40. The one or more rigid retention elements inhibit flexure of the interface portion about a longitudinal axis of the belt when the belt is fastened on a user. U.S. patent application Ser. No. 13/396,839, titled "Interlock System for a Respirator Waist Belt" and filed on the same date herewith, addresses the interface between the respiratory component and the belt assembly, and is incorporated herein by reference.

Figure 3:
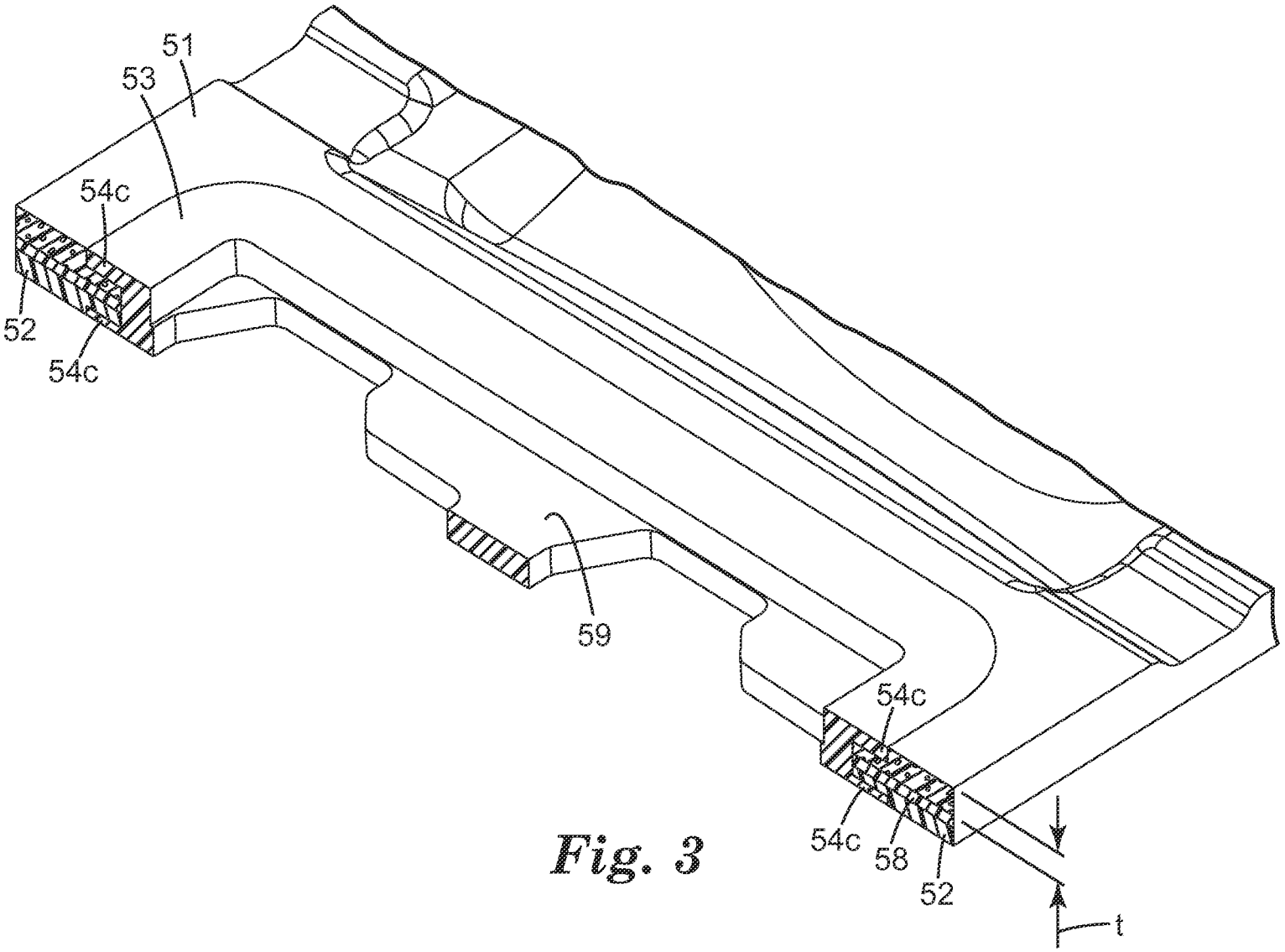
FIG. 3 is a perspective sectional view of an exemplary belt 40 according to the present invention taken along lines 3-3 of FIG. 2.

FIGS. 2 and 3 show an embodiment of a belt 40 according to the present invention. FIG. 2 provides a perspective view of belt 40, while FIG. 3 is a cross-sectional perspective view of belt 40 taken along lines 3-3 of FIG. 2. Belt 40 for carrying one or more respiratory components 12 includes a main belt portion 45, which extends around the back and sides of a user, and a strap portion 60, which extends across a front of a user. Main belt portion 45 includes a first end portion 46, a second end portion 47, and an interface portion 50 between the first and second end portions. In use, belt 40 distributes the weight of a respiratory component around a user's pelvis, and allows free leg movement of the user.

The strap portion 60 of exemplary belt 40 includes a left piece 61 connected to the first end portion 46 of the main belt portion 45, and a right piece 62 connected to the second end portion 47 of the main belt portion 45. Each piece 61 and 62 may be adjustable in length, or one of left and right pieces 61 and 62 may be adjustable in length, such that strap portion 60 may be adjusted to accommodate users of varying sizes. Free ends of left and right pieces 61 and 62 are selectively connected together by a buckle 65, for example, such as a releasable buckle, or another suitable buckle known in the art. Other means for joining the left and right pieces 61 and 62, as known in the art, may also be used. In an exemplary embodiment, first ends 63 and 64 of the left and right pieces 61 and 62 of the strap portion 60 are fixedly connected to the first and second end portions 46 and 47 of the main belt portion 45, for example by stitching, welding, adhesive, rivets, or other suitable means as known in the art, or the left and right pieces 61 and 62 may be integrally formed with the main belt portion 45. Alternatively, first and second ends 63 and 64 of the buckle portion may be detachably connected to the respective first and second end portions 46 and 47 of main belt portion 45 through slots, buckles, or other features that interact to releasably secure first and second ends 63 and 64 to the first and second end portions 46 and 47, as known in the art.

In an exemplary embodiment, main belt portion 45 includes channels 49 in a generally vertical orientation such that the channels are generally parallel to a vertical axis of a user when the belt is positioned for use about a user's waist. The channels are configured to allow the belt to flex in a manner such that the belt maintains a consistent curve when secured about a user's waist. The channels also provide a path for air to flow. This airflow provides cooling to a user and further enhances the perceived comfort of the belt.

Interface portion 50 of main belt portion 45 includes an inner layer 51, an outer layer 52, and a first rigid attachment element 53*a* in contact with inner layer 51 and outer layer 52. In some embodiments, first rigid attachment element 53*a* may be positioned partially or entirely between the inner layer 51 and the outer layer 52. In another embodiment, the first rigid attachment element may be positioned in the openings of the inner layer 51 and outer layer 52, and include one or more flanges or lips 54*c* extending over a portion of one or both of the inner layer 51 or outer layer 52. A portion of the inner layer 51 and outer layer 52 may be sandwiched between the flanges or lips 54*c* of the rigid attachment element 53*a*.

The first rigid attachment element is configured to mate with a corresponding feature of a respiratory component. Inner layer 51, outer layer 52, and rigid attachment element 53*a* each define an opening, and openings of the inner layer 51, outer layer 52, and rigid attachment element 53*a* are at least partially aligned to form a first common opening 54 extending through the interface portion 50. The openings of the inner layer 51, outer layer 52, and rigid attachment element 53*a* are sized and configured such that the first common opening 54 may receive one or more of projections 31 extending outwardly from an interface surface 30 of a respiratory component 12 to releasably secure the respiratory component 12 to the belt 40.

Those skilled in the art will recognize that further embodiments of an interface portion 50 may include additional openings, or additional rigid attachment elements. In the exemplary embodiment of FIG. 2, inner layer 51, outer layer 52, and a second rigid attachment element 53*b* each define a second opening, and the second openings are at least partially aligned to form a second common opening 55 extending through interface portion 50 of main belt portion 45. Alternatively, each rigid attachment element 53*a* and 53*b* may define a second opening, such that openings of inner layer 51, outer layer 52, and the second openings of the first and second rigid attachment elements are at least partially aligned to form third and fourth common openings 56 and 57, extending through interface portion 50. In another exemplary embodiment, rigid attachment elements 53*a* and 53*b* may be a single, unitary component positioned in contact with inner layer 51 and outer layer 52, and may define 1, 2, 3, 4, or more openings through interface portion 50 of main belt portion 45.

Interface portion 50 of main belt portion 45 has an inner layer 51, an outer layer 52, and a rigid attachment element 53 in contact with inner layer 51 and outer layer 52. Inner layer 51 is a cushioning layer, and is made of a material selected to provide a comfortable fit for the user. Inner layer 51 may be made of ethyl vinyl acetate (EVA). Other suitable materials include other EVA foams, rubbers, polyvinyl chloride, polyurethanes, and other suitable materials known in the art.

Inner layer 51 is configured to protect the user from pressure or discomfort that may otherwise result from rigid edges of the respiratory component or rigid portions of belt 40, and is intended to evenly distribute the weight of the respiratory component such that no areas of focused pressure impinge on a user's body. Inner layer 51 has a thickness t sufficiently large that no portion of a projection of a respiratory component extends entirely through common opening 54 beyond the exposed surface of inner layer 51. Further, the opening defined by inner layer 51 is larger than the opening defined by the first rigid attachment element 53*a*. In this way, the rigid attachment element 53 includes an exposed peripheral surface 59 which may interact with the projection of the respiratory component, as described in further detail below. Only the cushioned inner layer 51 contacts the user, and the rigid projection of a respiratory component is prevented from causing discomfort to a user.

In an exemplary embodiment, outer layer is an abrasion resistant layer made of a material selected to provide strength and rigidity to belt 40 such that belt 40 is sufficiently durable to endure repeated use in adverse environments. Outer layer 52 may be made of medium density EVA foam, neoprene rubber, polyvinyl chloride, polyurethane, rubber or other suitable materials known in the art. In an exemplary embodiment, outer layer 52 has a greater density than that of inner layer 51.

One or more layers of the belt may be made of leather, and may be joined to the other layers with rivets, stitching, adhesive, or other suitable means known in the art. A belt having a leather component may be especially suitable for applications in which a high level of durability is desired, such as in metal working applications. Such a belt may have all or any combination of the features and advantages as described herein.

Rigid attachment element 53 is made of a material having sufficient rigidity such that projections of a respiratory component may be received by rigid attachment element 53 in a secure and releasable engagement. In an exemplary embodiment, rigid attachment element 53 is made of a high density polyethylene. Other materials may include other suitable plastic or metallic materials as known in the art. In an exemplary embodiment, the rigid attachment element may be formed by injection molding or die cutting as known in the art, and is subsequently joined with inner layer 51 and outer layer 52, as described further below. Alternatively, the rigid attachment element may be formed by compression molding, transfer molding, or other suitable processes as known in the art.

The layers of an exemplary belt 40 according to the present invention may be joined to form a composite main belt portion having a plurality of laminated layers. Major surfaces of inner layer 51, outer layer 52, and rigid attachment element 53 are laminated to form the main belt portion of the belt assembly. In an exemplary embodiment, the layers may be joined by flame lamination. Each layer of material is heated until a thin layer of molten material is present on each major surface. The two layers are then pressed together, and are permanently welded together as each layer cools. In another exemplary embodiment, the inner layer and outer layer may be joined by flame lamination, and the rigid attachment element may be fastened to one or both of the inner layer and outer layer by adhesive or other suitable means to prevent removal of the rigid attachment element when securing or removing a respiratory component from the belt assembly. The rigid attachment element may be fastened with adhesive, stitches, rivets, snaps, hook and loop fasteners, connectors, welding, lamination, or other fastening means as known in the art. A rigid attachment element fastened to a portion of the belt does not need to be positioned by a user before the respiratory component is secured to the belt, and will not be inadvertently removed from the belt when the respiratory component is not secured to the belt. In other exemplary embodiments, the inner layer, outer layer, and rigid attachment element may be joined by a suitable adhesive, or any combination of suitable means as known in the art. For example, interface portion 50 may include a leather layer joined by rivets, adhesive, stitching, or any combination of suitable means as known in the art.

In an exemplary embodiment, the materials used to form inner layer 51, outer layer 52, and rigid attachment element 53 are selected such that the layers may be securely laminated. Separation of inner layer 51 or outer layer 52 from rigid attachment element 53 is substantially prevented during the useful life of the belt 40, and difficult to clean crevices that may otherwise result from separation of the layers is substantially prevented. In an exemplary embodiment, belt 40 is highly decontaminable despite having a rigid attachment element 53 in contact with a less dense inner layer 51 and outer layer 52.

Figure 4A:
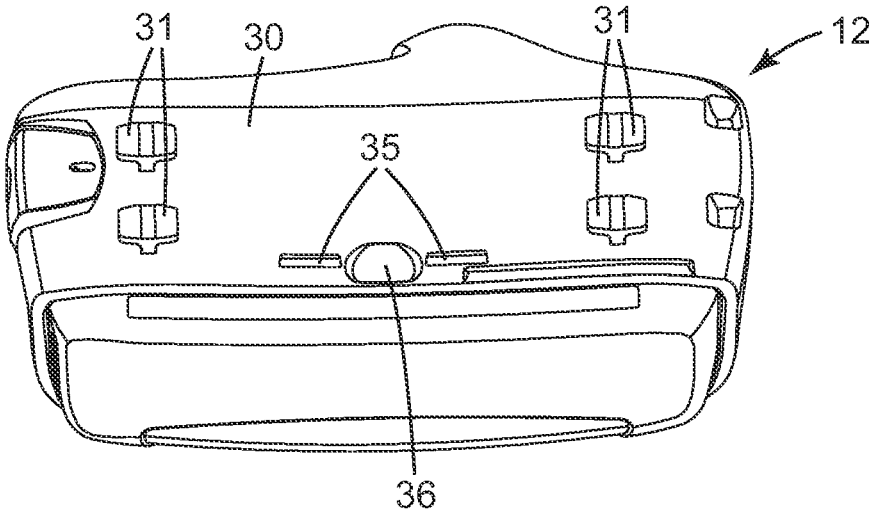
FIG. 4*a* is a perspective view of an interface surface of an exemplary respiratory component having a T-shaped projection according to the present invention.
Figure 4B:
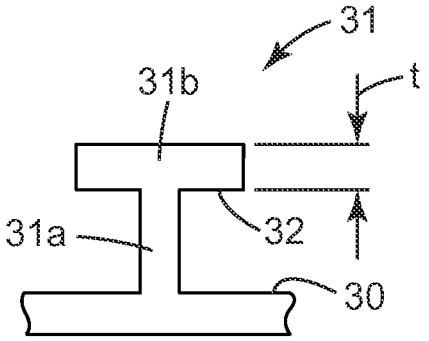
FIGS. 4*b*-4*d* are sectional views of exemplary T-shaped projections according to the present invention.

Rigid attachment elements 53*a*, 53*b*, mate with one or more projections 31 extending outwardly from an interface surface of a respiratory component. Rigid attachment element 53 is shaped and configured to releasably secure the respiratory component to belt 40. FIG. 4*a* is a perspective view, and FIG. 4*b* is a partial sectional view, of the interface surface 30 of a respiratory component 12 having a T-shaped projection 31 extending outwardly from the interface surface 30. As shown in FIG. 4*b*, projection 31 includes a first portion 31*a* extending outwardly in a direction substantially perpendicular to interface surface 30, and a second portion 31*b* extending from the first portion 31*a* in a direction substantially parallel to the interface surface and spaced apart from interface surface 30. Second portion 31*b* forms a flange or lip that engages with the rigid attachment element.

In an exemplary embodiment, the interface surface of the respiratory component includes a second projection, and may further include third and fourth projections. The four projections are spaced on the interface surface in a rectangular configuration, as shown in FIG. 4*a*, for example. The projections may also be arranged in other configurations corresponding to the design of the belt such that a respiratory component may be releasably secured to the belt assembly.

Figure 4C:
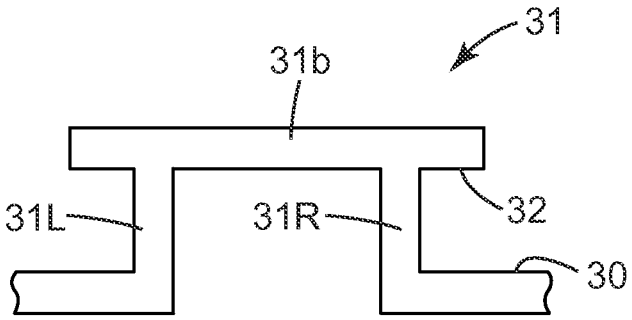
Figure 4D:
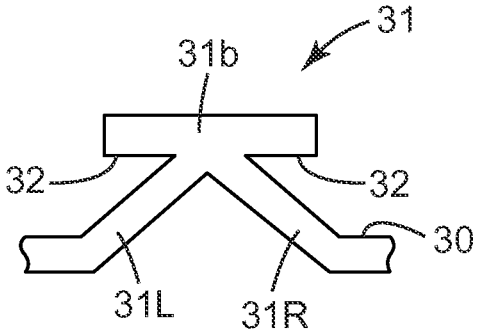
Figure 4E:
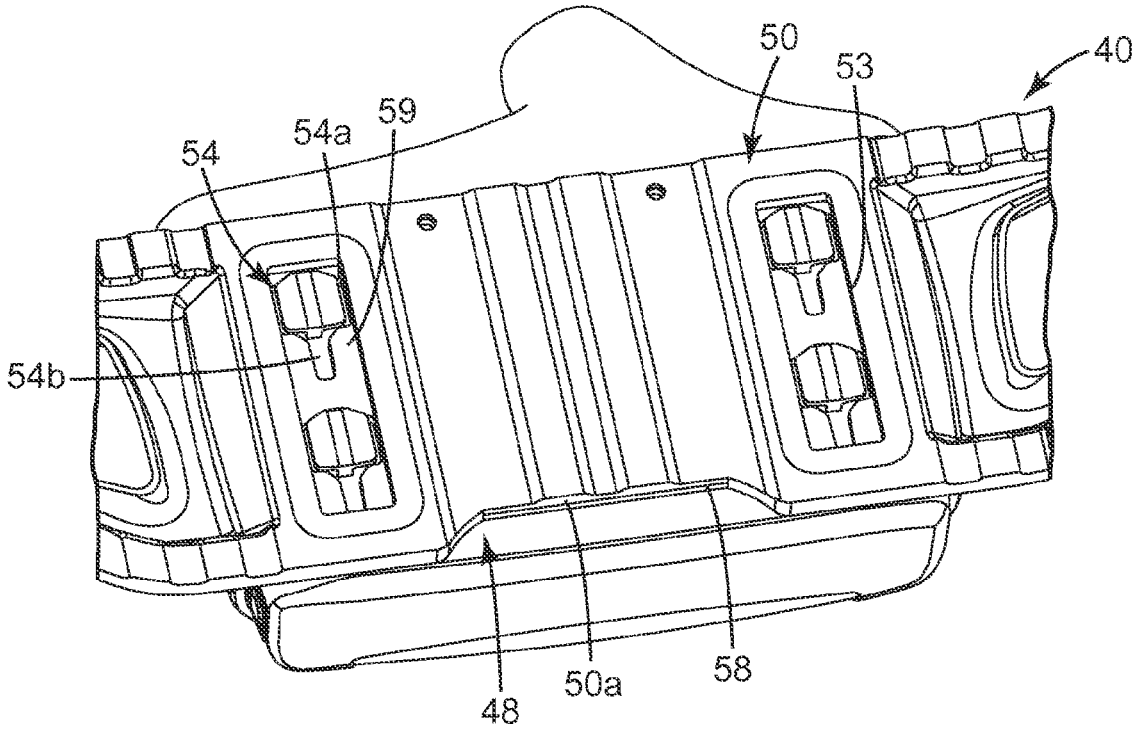
FIG. 4*e* is a perspective view of an exemplary respiratory system having a respiratory component and belt in an intermediate position according to the present invention.
Figure 4F:
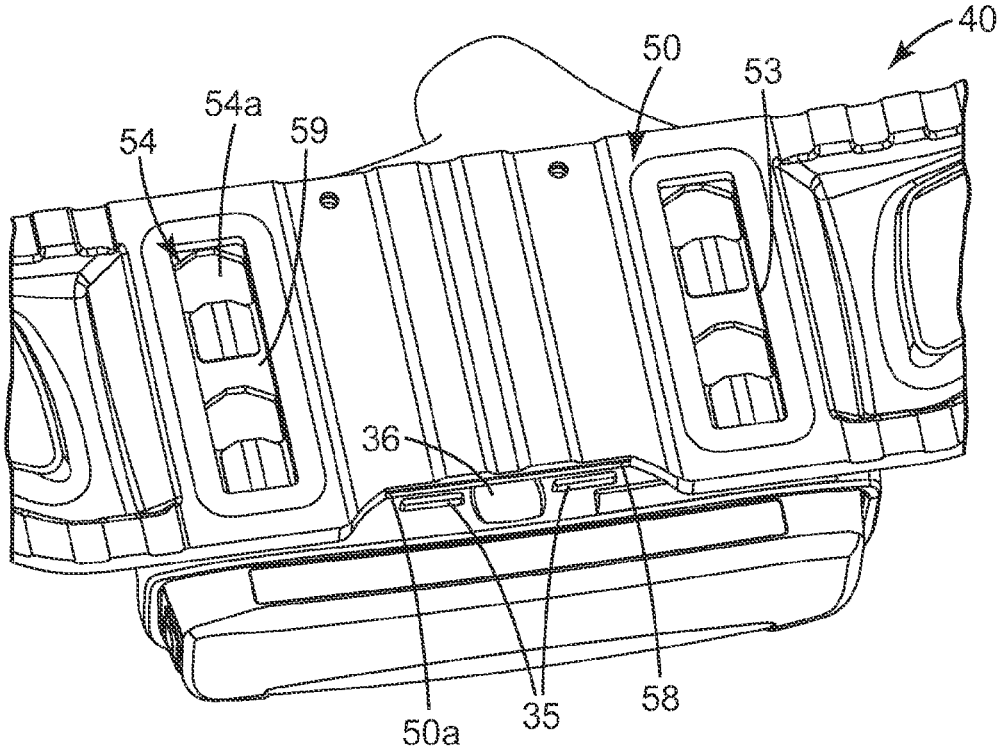
FIG. 4*f* is a perspective view of an exemplary respiratory system having a respiratory component releasably secured to a belt according to the present invention.

As shown in FIGS. 4*e* and 4*f*, interface portion 50 of belt 40 includes a T-shaped opening 54 having a large upper portion 54*a*, and a narrow lower portion 54*b* in the form of a slot. The large upper portion is sized to receive second portion 31*b* of projection 31, and lower portion 54*b* is in the form of a slot for receiving first portion 31*a* of projection 31. Accordingly, projection 31 may first be inserted through large upper portion 54*a* of opening 54, as shown in FIG. 4*e*, and subsequently slid along a vertical axis of a user into the position shown in FIG. 4*f*. Contact surface 32 of projection 31 engages with exposed peripheral surface 59 of rigid attachment element 53 to prevent movement of interface surface 30 of the respiratory component away from the interface portion of the belt. Thickness t of the second portion 31*b* of projection 31 is less than thickness t of the inner layer 51 of the belt such that the projection does not cause discomfort to the user when the belt is positioned on the user.

In the exemplary embodiment shown in FIG. 4*a*, interface surface 30 of the respirator component further includes one or more retention projections. Retention projection 35 includes a projection extending outwardly from interface surface 30. Retention projection 35 contacts an edge of interface portion 50, for example lower peripheral edge 50*a*, to prevent upward movement of the PAPR component with respect to the belt when the belt is fastened on a user, and to prevent inadvertent removal of the PAPR component from the belt when the belt is fastened on a user. In an alternative embodiment, retention projections 35 may be positioned to contact an upper edge or an edge of an opening defined by the belt to achieve the same function.

In an exemplary embodiment, interface portion 50 of belt 40 includes a rigid retention element 58 between the inner layer 51 and the outer layer 52. The rigid retention element has first and second opposing major surfaces, and inhibits flexure of the interface portion about a longitudinal axis of the belt when the belt is fastened to a user. When the lower peripheral edge 50*a* contacts retention projection 35, rigid retention element 58 provides sufficient stiffness that the belt does not slide over retention projection 35, and the PAPR component does not slide upward relative to the belt, when the belt is fastened to a user. In the exemplary embodiment shown in FIG. 4*f*, for example, lower peripheral edge 50*a* includes a recess or cavity 48, and retention projection 35 contacts lower peripheral edge 50*a* in the vicinity of the recess or cavity 48. After the belt is removed from the waist of a user, the lower peripheral edge may be manually raised above retention projection 35 such that the belt can be moved downward relative to the respiratory component 12 into the position shown in FIG. 4*e*, for example, and the respirator component may be separated from the belt by allowing the projections 31 to pass through larger upper portion 54*a* of opening 54 defined by the rigid attachment element. A depression or indent 36 is provided in interface surface 30 of respiratory component 12 to facilitate grasping the edge of the belt such that it may be more easily raised above retention projection 35.

Rigid retention element 58 and one or more rigid attachment elements 53 may be formed in a single piece, and may form a unitary component. In an exemplary embodiment, the features and advantages of a rigid attachment element and rigid retention element are obtained with a single component in contact with inner layer 51 and outer layer 52.

FIGS. 4*c* and 4*d* show cross-sectional views of alternative exemplary embodiments of T-shaped projections. T-shaped projection 31 shown in FIG. 4*c* includes first and second portions 31L and 31R extending outwardly in a direction substantially perpendicular to the interface surface 30, and a third portion 31*b* extending from first and second portions 31L and 31R in a direction substantially parallel to the interface surface and spaced apart from interface surface 30. The presence of first and second portions 31L and 31R may increase the strength and rigidity of projection 31, or may facilitate manufacture of projection 31. T-shaped projection 31 shown in FIG. 4*d* includes first and second portions 31L and 31R extending outwardly in an angled direction from the interface surface 30, and a third portion 31*b* extending from first and second portions 31L and 31R in a direction substantially parallel to the interface surface and spaced apart from the interface surface 30. A T-shaped projection includes these and other variations that improve the performance, or facilitate manufacturing, of the projection 31.

Figure 5A:
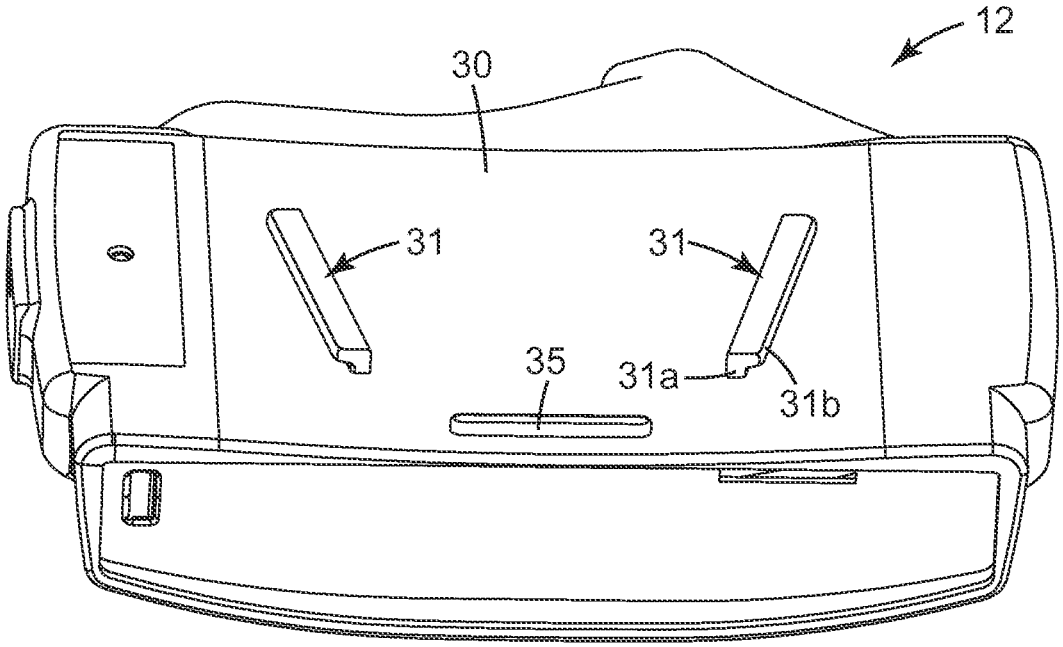
FIG. 5*a* is a perspective view of an interface portion of an exemplary respiratory component having an angled L-shaped projection according to the present invention.
Figure 5B:
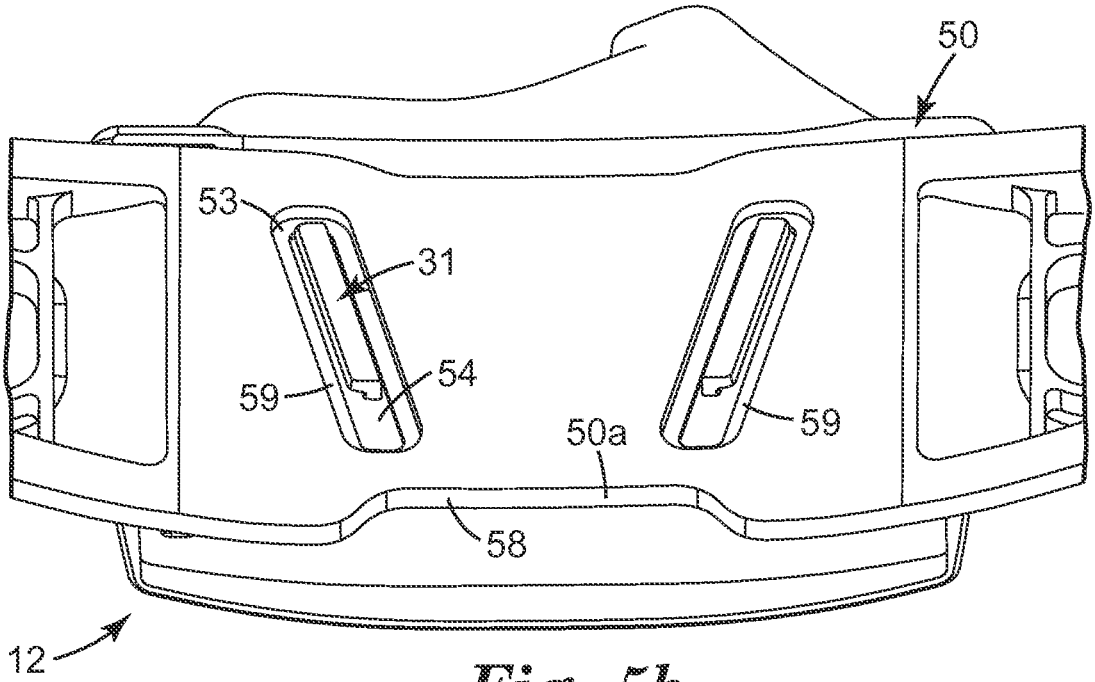
FIG. 5*b* is a perspective view of an exemplary respiratory system having a respiratory component and belt in an intermediate position according to the present invention.
Figure 5C:
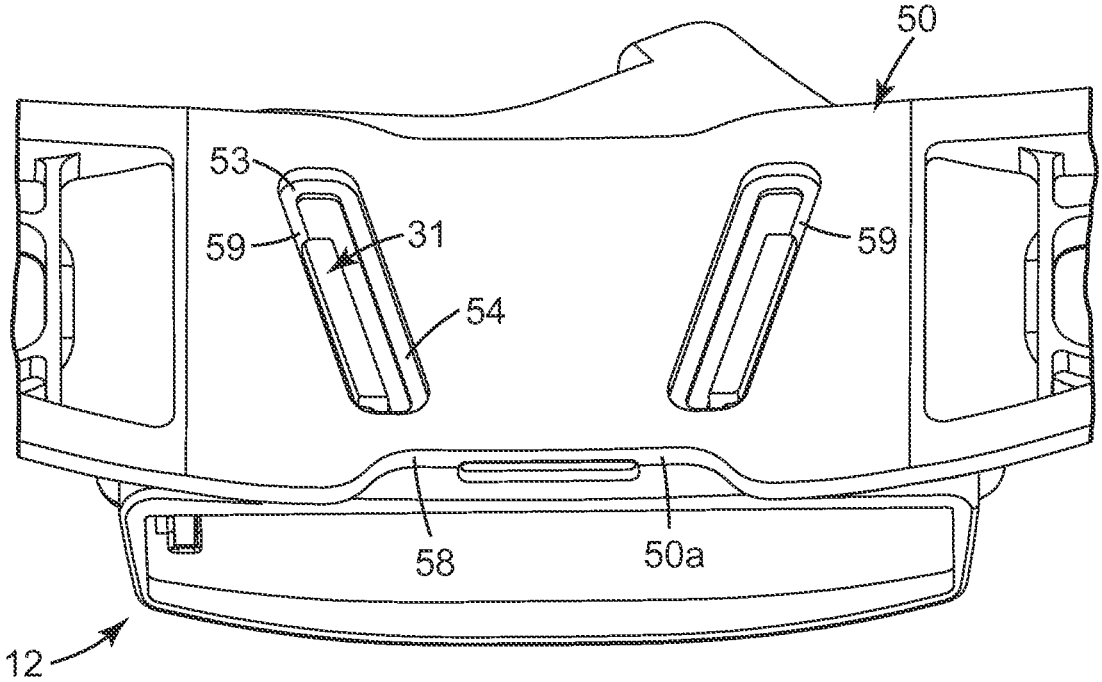
FIG. 5*c* is a perspective view of an exemplary respiratory system having a respiratory component releasably secured to a belt according to the present invention.

In the exemplary embodiment shown in FIGS. 5*a* through 5*c*, a rigid attachment element 53 defines an opening in the form of a slot 54 angled with respect to a vertical axis of a user for receiving an L-shaped projection 31 similarly angled with respect to the vertical axis. FIG. 5*a* is a perspective view of interface surface 30 of a respiratory component 12 having an angled L-shaped projection 31 extending outwardly from interface surface 30. Projection 31 includes a first portion 31*a* extending outwardly in a direction substantially perpendicular to the interface surface, and a second portion 31*b* extending from first portion 31*a* in a direction substantially parallel to interface surface 30 and spaced apart from interface surface 30. Second portion 31*b* forms a flange or lip that engages with the rigid attachment element. As shown in FIG. 5*b*, interface portion 50 of belt 40 includes an opening 54 in the form of an angled slot. The slot and the projection are substantially similarly angled with respect to the vertical axis, and the length of slot 54 is greater than the length of projection 31.

In use, projections 31 may first be inserted through slot 54 at an upper portion of the slot, as shown in FIG. 5*b*, and subsequently slid downward along a vertical axis of the user into the position shown in FIG. 5*c*. As the respirator component is slid downward, second portions 31*b* of projections 31 come into contact with a peripheral surface 59 of rigid attachment element 53. The contact prevents movement of respiratory component 12 with respect to interface portion 50 of belt 40 when respiratory component 12 is releasably secured to interface portion 50 of belt 40, as shown in FIG. 5*c*.

In the exemplary embodiment shown in FIGS. 5*a* through 5*c*, interface surface 30 of the respirator component further includes one or more retention projections. Retention projection 35 includes a projection extending outwardly from the interface surface 30. Retention projection 35 contacts an edge of interface portion 50, for example lower peripheral edge 50*a*, to prevent upward movement of the PAPR component with respect to the belt, and to prevent inadvertent removal of the PAPR component from the belt, when the belt is fastened on a user.

Interface portion 50 includes a rigid retention element 58 between inner layer 51 and outer layer 52. The rigid retention element has first and second opposing major surfaces, and inhibits flexure of the interface portion about a longitudinal axis of the belt when the belt is fastened to a user. When lower peripheral edge 50*a* contacts retention projection 35, the rigid retention element provides sufficient stiffness that the belt does not slide over retention projection 35, and the PAPR component does not slide upward relative to the belt, when the belt is fastened to a user. After the belt is removed from the waist of a user, the lower peripheral edge may be manually raised above retention projection 35 such that the belt can be moved downward relative to respiratory component 12. The respirator component may be separated from the belt by allowing projections 31 to move to the upper portion of slots 54 into the position shown in FIG. 5*b* such that projections 31 do not engage the peripheral surface, and the projections may pass through slots 54 to allow the respiratory component to be separated from belt 40.

Rigid retention element 58 and one or more rigid attachment elements may be formed in a single piece, and may form a unitary component. In an exemplary embodiment, the features and advantages of a rigid attachment element 53 and rigid retention element 58 are obtained with a single component in contact with inner layer 51 and outer layer 52.

Figure 6A:
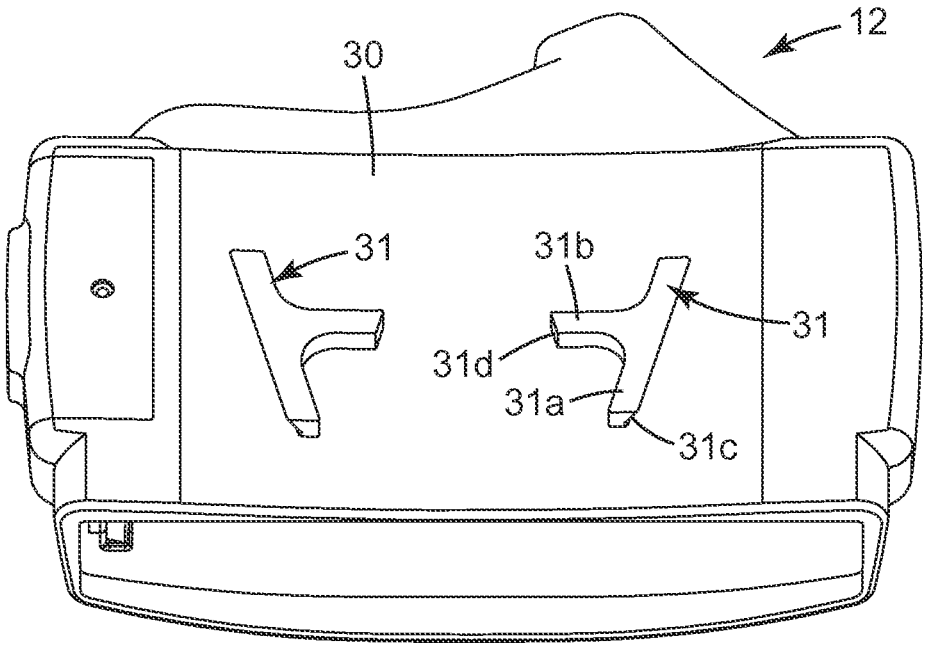
FIG. 6*a* is a perspective view of an interface portion of an exemplary respiratory component according to the present invention.
Figure 6B:
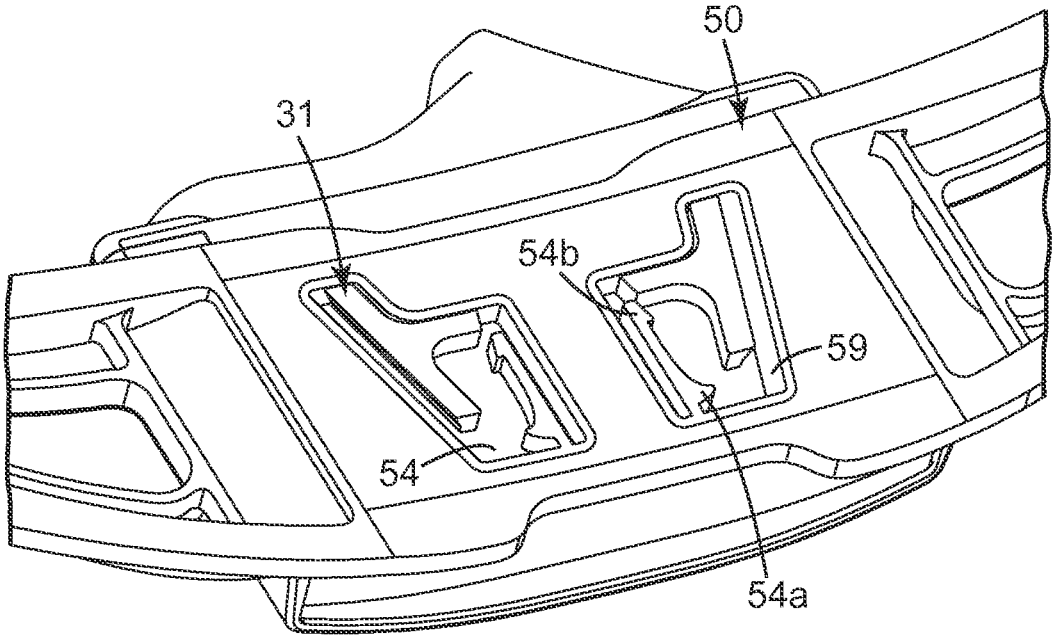
FIG. 6*b* is a perspective view of an exemplary respiratory system having a respiratory component and a belt in an intermediate position according to the present invention.
Figure 6C:
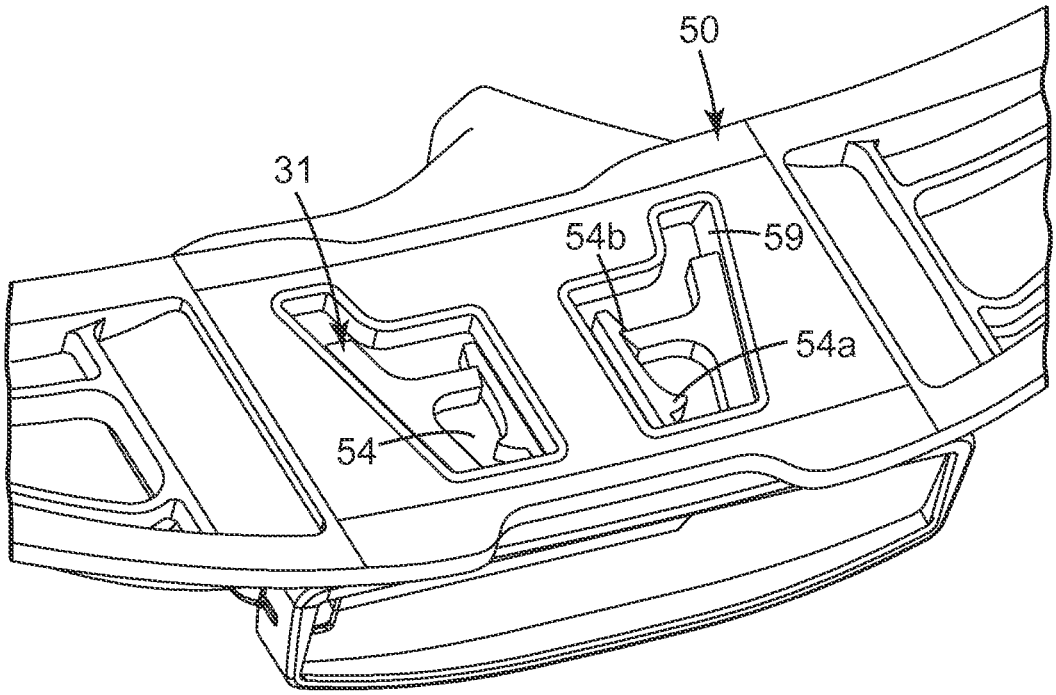
FIG. 6*c* is a perspective view of an exemplary respiratory system having a respiratory component releasably secured to a belt according to the present invention.

In the exemplary embodiment shown in FIGS. 6*a* through 6*c*, the rigid attachment element defines an opening 54 for receiving a projection 31. FIG. 6*a* is a perspective view of interface surface 30 of a respiratory component 12 having a projection 31 extending outwardly from interface surface 30. Projection 31 includes a first portion 31*a* extending outwardly from the interface surface and angled with respect to a vertical axis of a user, and a second portion 31*b* extending outwardly from the interface portion and extending from first portion 31*a* in a direction substantially perpendicular to the vertical axis of the user. First portion 31*a* has an angled surface 31*c*, such that first portion 31*a* has a wedge shaped cross-section. Second portion 31*b* has an angled end surface 31*d*. As shown in FIG. 6*b*, interface portion 50 of belt 40 includes an opening 54 defined by rigid attachment element 53. The rigid attachment element includes a cantilever 54*a* having a free end with a step 54*b*. Cantilever 54*a* is able to flex to accommodate projection 31 between stepped end 54*b* and an angled peripheral edge 59 of rigid attachment element 53, as shown in FIG. 6*c*, for example.

In use, projections 31 may first be inserted through an upper portion of slot 54, as shown in FIG. 6*b*, and subsequently slid downward along a vertical axis of the user into the position shown in FIG. 6*c*. As the respiratory component 12 is slid downward, cantilever 54*a* flexes to accommodate projection 31 between cantilever 54*a* and angled peripheral edge 59 of the rigid attachment element. Angled peripheral edge 59 contacts angled surface 31*c* and prevents separation of respiratory component 12 from interface portion 50 of belt 40. Movement in a horizontal or vertical direction is prevented by the interaction of stepped end 54*b* of cantilever 54*a* with second portion 31*b* of projection 31, and interaction of angled peripheral edge 59 with angled surface 31*c*. Specifically, the step contacts second portion 31*b* of projection 31 to prevent upward movement of the respiratory component with respect to interface portion 50 of belt 40 when the belt is fastened on a user. Frictional contact prevents movement of respiratory component 12 with respect to interface portion 50 of the belt when respiratory component 12 is releasably secured to interface portion 50 of belt 40, as shown in FIG. 6*c*.

The belt and respiratory component having some or all of the features described herein exhibit several desirable characteristics including a unique combination of a belt and respiratory component that provide a highly secure engagement, while remaining highly decontaminable. The presence of projections extending outwardly from the interface surface of the respiratory component, and the absence of slots or unnecessary crevices, enhances the decontaminability of the respiratory component, and results in an easily cleanable device. Similarly, a belt that includes a laminated construction having a rigid attachment element positioned in contact with an inner and outer layer eliminates the need for slots or hard to reach crevices, and results in a highly decontaminable and easily cleanable belt. The design and configuration of the belt and respiratory component as described in the present invention substantially eliminates the need for moving parts that create difficult to clean areas. The belt and respiratory component according to the present invention may be efficiently and effectively cleaned manually or by other suitable means as known in the art.

The belt according to the present invention allows a respiratory component to be quickly and easily secured to the belt assembly, while substantially preventing the respiratory component from becoming inadvertently detached from the belt assembly. The presence of a rigid attachment element allows a respiratory component having corresponding projections to be easily secured to the belt assembly, and the presence of a rigid retention element, in combination with a retention projection on an interface surface of the respiratory component, prevents the respiratory component from becoming detached from the belt assembly.

The present invention has now been described with reference to several embodiments thereof. The foregoing detailed description and examples have been given for clarity of understanding only. No unnecessary limitations are to be understood there from. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A wearable belt for supporting a respiratory component, comprising:

a wearable belt having a first end portion, a second end portion, and an interface portion between the first and second end portions;

wherein the interface portion comprises an inner layer, an outer layer, a rigid retention element, and a first rigid attachment element in contact with the inner layer and the outer layer and configured to mate with a corresponding feature of a powered air purifying respirator (PAPR) component, and wherein the inner layer, the outer layer, and the first rigid attachment element each define an opening, and the openings are at least partially aligned to form a first common opening extending through the interface portion, and wherein the rigid retention element inhibits flexure of the interface portion about a longitudinal axis of the belt when the belt is fastened on a user.

2. The belt of claim 1, wherein the rigid attachment element includes one or more flanges extending over a portion of the inner layer and the outer layer.

3. The belt of claim 1, wherein the rigid attachment element includes an exposed surface configured to contact a corresponding feature of a PAPR component when the PAPR component is releasably secured to the belt.

4. The belt of claim 1, further comprising a second rigid attachment element, wherein the inner layer, the outer layer, and the second rigid attachment element each define an opening, and the openings are at least partially aligned to form a second common opening extending through the interface portion.

5. The belt of claim 1, wherein the first rigid attachment element defines a T-shaped opening.

6. The belt of claim 1, wherein the belt includes four T-shaped openings spaced in a rectangular configuration on the interface surface of the belt.

7. The belt of claim 1, wherein the first and second end portions each comprise a bumper wing.

8. The belt of claim 1, wherein the interface portion has a laminated construction.

9. The belt of claim 1, wherein the first rigid attachment element comprises a plastic injection molded element.

10. The belt of claim 1, wherein the first rigid attachment element comprises a die-cut element.

11. The belt of claim 1, wherein the first rigid attachment element is made of high density polyethylene.

12. The belt of claim 1, wherein the inner layer is a cushioning layer.

13. The belt of claim 1, wherein the inner layer comprises a material selected from the group consisting of ethylene-vinyl acetate foam, polyvinyl chloride, polyurethane, and rubber.

14. The belt of claim 1, wherein the outer layer is abrasion resistant.

15. The belt of claim 1, wherein the outer layer comprises a material selected from the group consisting of ethylene-vinyl acetate foam, polyvinyl chloride, polyurethane, neoprene rubber, and rubber.

16. The belt of claim 1, wherein the interface portion comprises a lower peripheral edge and the rigid retention element is positioned between the inner layer and the outer layer having a lower edge adjacent to the lower peripheral edge of the interface portion.

17. The belt of claim 1, wherein the first rigid attachment element and the rigid retention element form a unitary component.

18. The belt of claim 1, wherein the rigid attachment element and the rigid retention element do not form a unitary component.

* * * * *